US006828552B2

(12) United States Patent
Hartley

(10) Patent No.: US 6,828,552 B2
(45) **Date of Patent: *Dec. 7, 2004**

(54) SOFT IONIZATION DEVICE WITH CHARACTERIZATION SYSTEMS AND METHODS OF MANUFACTURE

(75) Inventor: Frank T. Hartley, Arcadia, CA (US)

(73) Assignee: Ionfinity LLC, Altadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/452,343

(22) Filed: Jun. 2, 2003

(65) Prior Publication Data

US 2003/0201389 A1 Oct. 30, 2003

Related U.S. Application Data

(62) Division of application No. 10/180,813, filed on Jun. 25, 2002.

(60) Provisional application No. 60/301,092, filed on Jun. 25, 2001, provisional application No. 60/336,841, filed on Oct. 31, 2001, and provisional application No. 60/347,685, filed on Jan. 8, 2002.

(51) Int. Cl.[7] ..... H01J 49/40; H01J 49/10

(52) U.S. Cl. ..... 250/287; 250/423 F

(58) Field of Search ..... 250/287, 423 F, 250/423 R; 313/230

(56) References Cited

U.S. PATENT DOCUMENTS

| | | | | | |
|---|---|---|---|---|---|
| 3,699,333 | A | * | 10/1972 | Cohen et al. | 250/287 |
| 4,485,822 | A | * | 12/1984 | O'Connor et al. | 600/532 |
| H406 | H | * | 1/1988 | Wohltjen | 250/287 |
| 5,032,721 | A | * | 7/1991 | Bacon et al. | 250/287 |
| 6,074,608 | A | * | 6/2000 | Matz | 422/83 |
| 6,124,592 | A | * | 9/2000 | Spangler | 250/287 |
| 6,480,278 | B1 | * | 11/2002 | Fuerstenau et al. | 250/281 |
| 6,495,823 | B1 | * | 12/2002 | Miller et al. | 250/286 |
| 6,610,986 | B2 | * | 8/2003 | Hartley | 250/287 |

* cited by examiner

*Primary Examiner*—Jack Berman
(74) *Attorney, Agent, or Firm*—Carl A. Kukkonen, III

(57) ABSTRACT

Various configurations of characterization systems such as ion mobility spectrometers and mass spectrometers are disclosed that are coupled to an ionization device. The ionization device is formed of a membrane that houses electrodes therein that are located closer to one another than the mean free path of the gas being ionized. Small voltages across the electrodes generate large electric fields which act to ionize substantially all molecules passing therethrough without fracture. Methods to manufacture the mass spectrometer and ion mobility spectrometer systems are also described.

99 Claims, 4 Drawing Sheets

SOFT IONIZATION DEVICE WITH CHARACTERIZATION SYSTEMS AND METHODS OF MANUFACTURE

This application is a divisional of U.S. patent application Ser. No. 10/180,813 entitled "Field Ionizing Elements and Applications Thereof" filed Jun. 25, 2002, claims benefit of U.S. Provisional Application No. 60/301,092, filed Jun. 25, 2001, U.S. Provisional Application No. 60/336,841 filed on Oct. 31, 2001, and U.S. Provisional Application No. 60/347,685 filed on Jan. 8, 2002, all of which are hereby fully incorporated by reference.

This invention was made in part with Government support under contract NASA-1407 awarded by NASA. The Government has certain rights in this invention.

BACKGROUND

Many different applications are possible for ionization systems. For example, it is desirable to form a pumpless, low mass sampling system for a mass spectrometer.

Conventional mass spectrometers often use "hard" techniques of producing ion fragments, in which certain parts of the molecule are forcibly removed, to form the fragmented ion. For example, the fragments may be produced by ultraviolet, radioactive, and/or thermal electron ionization techniques. Some of these techniques, and specifically the thermal technique, may require a vacuum to enhance the life of the filament source.

Different systems which use ionization are known. A quadrupole and magnetic sector/time of flight system ionizes a sample to determine its content. These devices have limitations in both operation and size. Many devices of this type may operate over only a relatively small mass sampling range. These devices may also suffer from efficiency issues, that is the ions might not be efficiently formed.

Many of these systems also require a very high vacuum to avoid ion collisions during passage through the instrument. For example, the systems may require a vacuum of the level of such as $10^{-6}$ Torr. A vacuum pump must be provided to maintain this vacuum. The vacuum pump consumes power, may be heavy, and also requires a relatively leak free environment. This clashes with the usual desire to miniaturize the size of such a device.

Other applications could be desirable for ionization, if an ionization system were sufficiently small. However, the existing ionization systems have problems and difficulties in fabrication which has prevented them from being used in certain applications.

SUMMARY

The present application describes a special ionization membrane, along with applications of this special ionization membrane that are facilitated by the membrane.

A first application uses the ionization membrane as part of a mass spectrometer.

Another application uses the ionization membrane for other applications. According to an aspect of this invention, the electrodes are formed closer than the mean free path of a specified gas, for example the gas being considered. This may ionize gas molecules in free space. Different applications of this soft ionization technique are described including using this system in a mass spectrometer system, such as a rotating field mass spectrometer. This may also be used in a time of flight system.

In an embodiment, a pumpless mass spectrometer is described which does not include a pump for either forming the vacuum or for driving the ions.

Another embodiment describes using this system for an electrochemical system. Another application describes using this system in propulsion.

BRIEF DESCRIPTION OF THE DRAWINGS

These and other aspects will now be described in detail with reference to the accompanying drawings, wherein.

DETAILED DESCRIPTION

Gas may be ionized in a high electric field. Avalanche arcing may be produced by the gas ionization. It has been found by the present inventor, however, that when the "mean free path" between molecules is greater than electrode separation, only ionization occurs.

Figure 1:
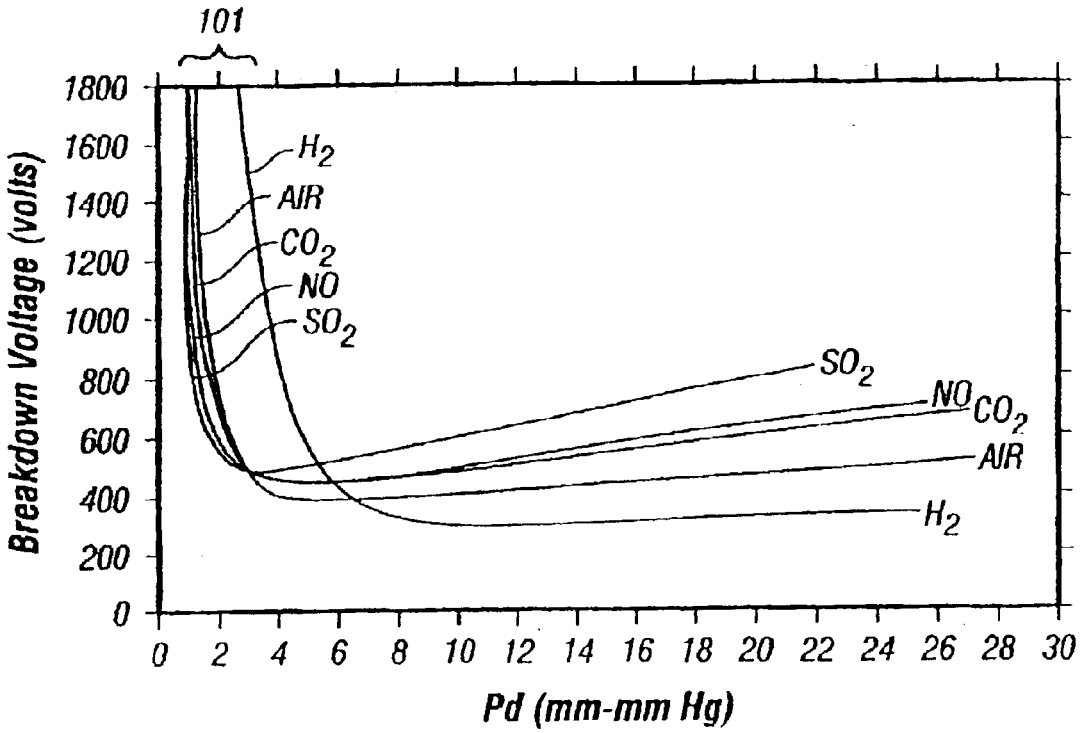
FIG. 1 shows Paschen curves for various gases.

FIG. 1 shows the Paschen curves for various gases. This represents the breakdown voltage of the gas at various characteristic points. On the left side and under each Paschen curves ionization of the gas occurs using the special membrane described herein. This technique is "soft" in the sense that it ionizes without fragmenting the molecular structure of the gas being ionized. That means that large organic compounds can be analyzed without breaking them into smaller atomic fragments.

Figure 2A:
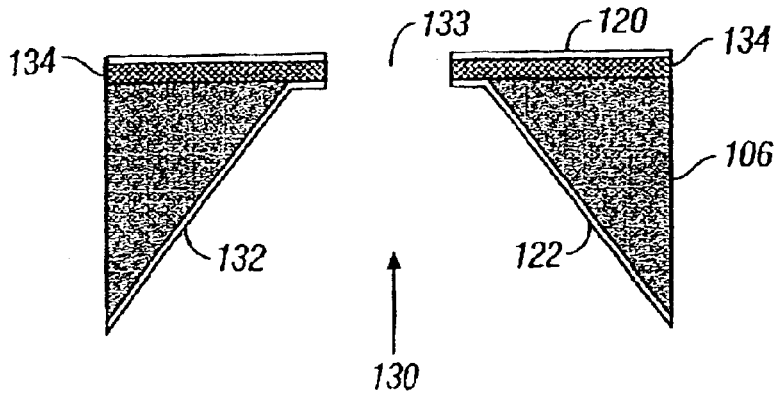
FIGS. 2*a*–2*c* show details of the special ionization membrane of the present system, with FIG. 2*b* showing a cross-section along the line 2*b*—2*b* in FIG. 2*c* and FIG. 2*a* showing a close-up detail of one of the holes in FIG. 2*b;*
Figure 2B:
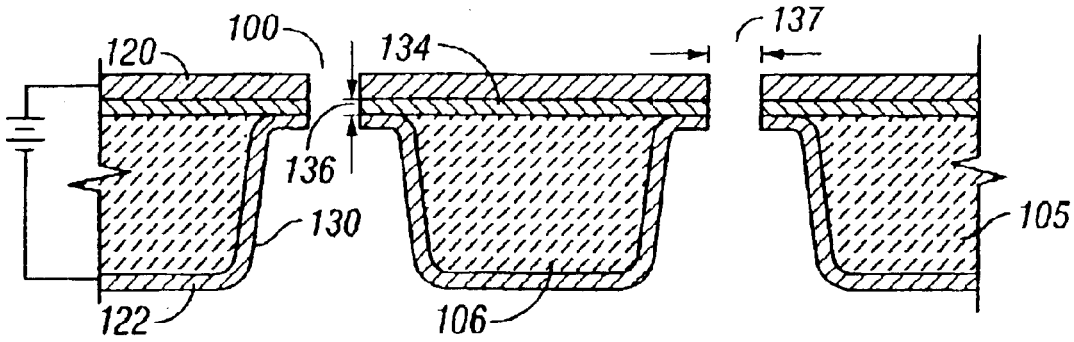
Figure 2C:
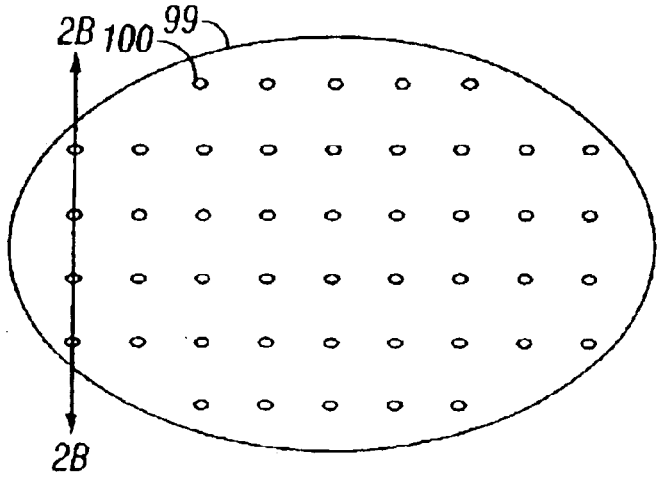

Details of the membrane are shown in FIGS. 2A–2C, with FIGS. 2A & 2B showing cross sections of the membrane of FIG. 2C. The miniature ionization device 99 is formed by micromachining an array of small holes 100 through a relatively thin membrane 105. The membrane 105 may be, for example, of sub micron thickness. The material 106 of the substrate itself may be silicon or any other easy-to-machine material. Metal electrodes 120, 122 are located on respective sides of the membrane 100. The metal can be any material such as chrome or titanium or gold.

In formation of the membrane 99, a plurality of holes such as 130 are formed from the bottom 132. The holes may generally taper as shown towards the top portion 133 of the hole. The top portion 133 of the hole 130 may have a dimension 137 which may be, for example, 2 to 3 microns. Openings may be formed in the top metal coating 120, and in the bottom metal coating 122. For example, the hole may be formed by focused ion-beam milling (maskless process).

The substrate material 106 also includes a dielectric layer 134 which can be for example, silicon nitride, alumina, or any other similar material that has a similar dielectric breakdown. The thickness 136 of the dielectric layer sets the distance between the metal electrodes 120 and 122. The dielectric thickness can be to 200–300 nm The dielectric can in fact be thinner than 200 nm, in fact can be any thickness, with thicknesses of 50 nm being possible.

In a preferred system, the distance between the electrodes 120, 122 is less than 1 micron. When this small separation is maintained, electric field strengths on the range of mega volts per meter are produced for each volt of potential difference between the electrodes 120, 122.

The inventor has noted that the membranes could not be formed simply from the thin, sub micron elements. Membranes that are formed in this way could be too fragile to sustain a pressure difference across the membrane, or to survive a minor mechanical shock. In this embodiment, the thicker supporting substrate part 105 is used, and is back-etched through to the membrane. By forming the substrate in this way, that is with a relatively thick substrate portions such as 105/106, separated by back etched holes such as 100, the structure of the device can be maintained while keeping a relatively small distance between the electrodes.

An embodiment is described herein which uses the field ionizer array, which may be a micromachined field ionizer membrane, with a lateral accelerator, which is coupled to a mass spectrometer. An array of cathodes may be deployed to detect the position of impinging of the particles.

The cathode electrodes may be derived from an active pixel sensor array of the type described in U.S. Pat. No. 5,471,215, and as conventional may include various types of on-chip matrix processing. This system may use an electrode sensor of 1024 by 1024 pixels, with sub pixel centroiding and radial integration. The active pixel sensor itself may have a sensitivity on the order of $10^{-7}$ amps. By adding pixel current processing, another two orders of magnitude of sensitivity may be obtained.

Forming the mass spectrometer in this way enables the device to be formed smaller, lighter, and with less cost than other devices of this type. This enables a whole range of applications; such as in situ biomedical sampling. One application is use of the miniature mass spectrometer is for a breathalyzer. Since there are no electron beam filaments and the like, any of the system components can operate at relatively higher pressures, for example 5 to 7 Torr pressures or higher. With a Faraday cup electrometer ion detector, sub femtoamp levels of sensitivity may be obtained. This system could be used as a portable device for finding various characteristics in exhaled breath. For example, detection of carbon monoxide in exhaled breath may be used as a screening diagnostic for diabetes.

Figure 3:
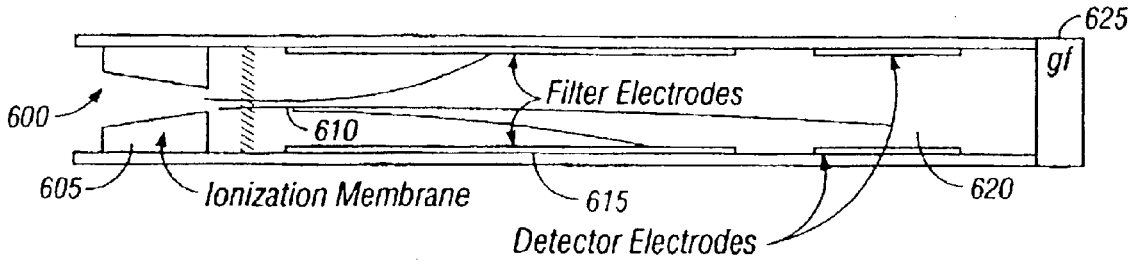
FIG. 3 shows an ion mobility spectrometer.

Another application of this system is for use in a miniature ion mobility spectrometer as shown in FIG. 3. Conventional ion mobility spectrometers use a shutter gate. This provides short pulses of ions. The shortened pulses of ions are often limited to about 1 percent of the total number of ions that are available for detection. However, resolution of such a device is related to the width of the ion pulse. The width of the ion pulse cannot be increased without correspondingly decreasing the resolution.

In the improved system of FIG. 3, total and continuous ionization of sample gas and continuous introduction of all ions into the chamber is enabled. Sample gases are introduced as 600 into the ionization membrane 605 of the type described above. In general, the ionization membrane 605 could include either a single pore device or could have multiple pores within the device.

Ions 610 from the membrane exit the membrane as an ion stream. Electrons in contrast move back behind (that is, to the other side of) the membrane, and may further contribute to the ionization of the incoming gases. The atoms or molecules are carried through the body of the spectrometer by a gas feed system 625. The gas feed system includes either an upstream carrier gas supply and Venturi sampler, or a downstream peristaltic pump.

The ions are drawn towards the filter electrode 615 which receive alternating and/or swept DC electric fields, for the transverse dispersal of the ions. A repetitive ramping of the DC fields sweeps through the spectrum of ion species.

An important feature of this device is the high field strengths which can be obtained. At moderate field strengths, for example <100,000 volts per meter, the mobility of ions at atmospheric and moderate pressures is constant. However, at higher field strengths, such as 2 million volts per meter or greater, the mobility of the ions is nonlinear. The mobility changes differentially for high and low mobility ions. This change may be, for example, by 20 percent. Therefore, by applying a waveform that is formed of a short high-voltage and a long low or negative voltage to the filter electrodes, the ion species is disbursed between the filter electrodes. This waveform may be selected to provide a zero time averaged field. In operation, the ions are transported laterally by a carrier gas stream. A low strength DC field may be supplied in opposition to the other field. This fields applied to the filter electrode may straighten the trajectory of specific ion species, allowing their passage through the filter. The other ion species collide with the electrodes. Sweeping of the DC field may facilitate detection of the complete ion spectrum.

Detector electrodes 620 are located downstream of the filter electrodes 615. The selected ions have straightened trajectories, and these detector electrodes 620 deflect the straightened-trajectory ions into detection electrodes, where they are detected. The detected current provides a direct measure of the number of ions. The number of ions is effectively proportional to the vapor concentration.

It should be understood that this gas feed system could be either upstream or downstream in this way.

Another embodiment uses this ionization technique to form a free space ion thruster.

Figure 4:
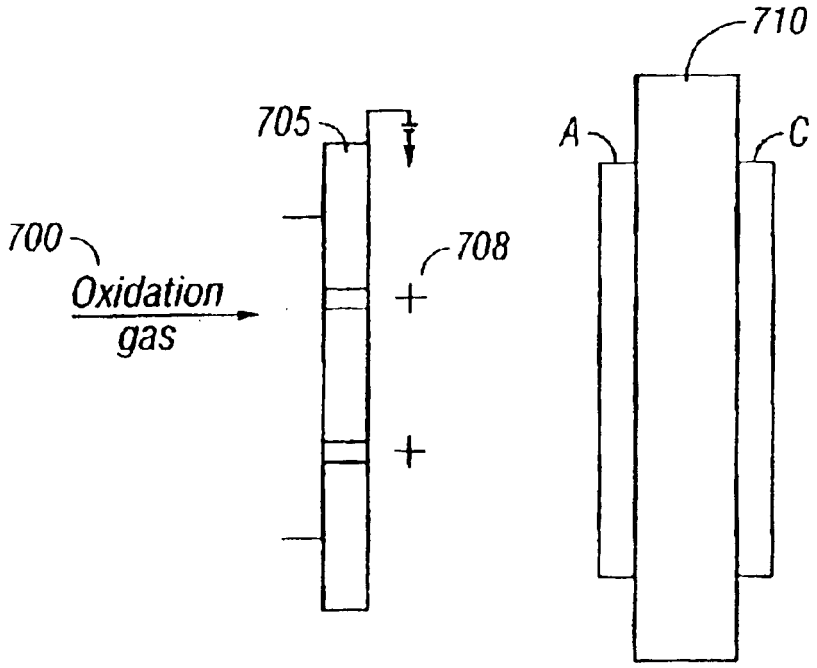
FIG. 4 shows a solid-state ionization membrane being used in an electrochemical device.

Yet another embodiment describes use of an ionizer of this type in a fuel cell. Previous fuel cell proton exchange membranes have used platinum or other electrooxidation catalysts to facilitate proton transfer. In this system, the oxidation gas or gases 700 is passed through the pores of a membrane 705 under an extreme electric field as shown in FIG. 4. The oxidation gas or gases 700 are completely ionized on passage through the membrane. The gas 708 once ionized, now has a positively charged aspect. The gas 708 drifts to the membrane 710 where the electrooxidized state of the gas enhances its transfer through the cathode. The transfer of atomic species through the membrane in this way reduces the partial pressure between the ionizer 705 and the membrane 710, this causing further inflow through the ionizer pores of the oxidation gas 702. The ionizer potential may alternatively be maintained positive with respect to the cathode membrane in order to accelerate the ions to an increased velocity before imprinting on the cathode membrane which forms the accelerator grid.

Figure 5:
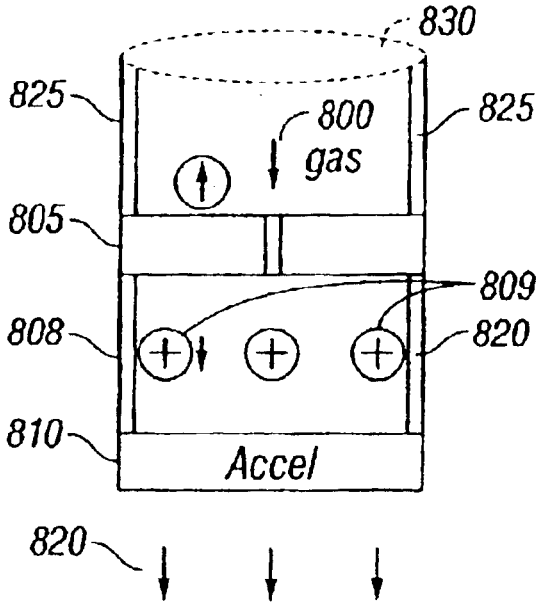
FIG. 5 shows the ionization membrane being used as a propulsion system.

Another embodiment, shown in FIG. 5, uses this ionization membrane as part of a miniature ion thruster. This may form a thrust system using propellant gas. Propellant gas 800 is ionized by passing it through the pores of a membrane 805 of the type described above, under a high electric field. This forms positively charged ions 809 from the gas. The ions 809 enter another field 808 between the membrane and a porous accelerator grid 810. This other field 808 accelerates the ions to an increased velocity, and expels them from the thruster as 820.

The electrons are caused to move back behind the membrane where a small electric field and magnetic field may linearly and rotationally accelerate the electron beam around to eject the electrons from the thruster with the same vector but reduced velocity as the ion beam. Since the ion and electron currents are substantially identical, this system becomes effectively charge neutral.

This system may use a small tube 820 of 1.5 cm long; 2 mm in diameter, of dielectric materials such as quartz. The tube 820 may be eutectically bonded to the top of the membrane 805. The micromachined conductive grid is similarly affixed to the top of the tube. The bottom of the membrane may also be eutecticly bonded to a thruster housing 825. That housing may contain another accelerating grid 830 and magnets.

Figure 6:
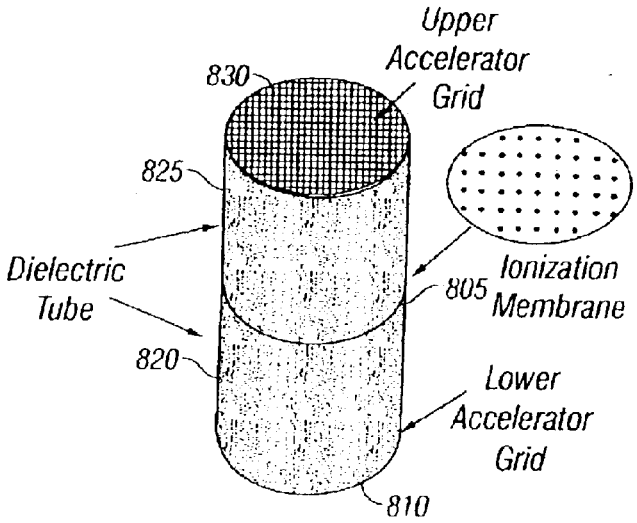
FIG. 6 shows this propulsion system in its housing with top and bottom accelerator grids.

An exterior view of the structure is shown in FIG. 6, which shows the tube for any particular accelerator grid potential, the thrust of the engine is determined by the gas flow through the membrane pores. This system may use a plurality of miniature ionization tubes such as the one described above, that are disbursed across the surface of the structure. These tubes may be deployed individually or collectively by connecting them into a circuit. The ions from each of these tubes are accelerated under the influence of a localized electric field that is along the vector representing the least distance to the peripheral grid. The aggregate thrust is the geometrically integrated mass-momentum of all connected free space ion thrusters.

In this embodiment, a bipolar ion thruster may allow reversing the electrode potentials on the ionization membrane, causing the electrons to pass through the membrane, while ions move behind the membrane. The high velocity ions are expelled from the front of the thruster, and electrons are expelled from the rear of the thruster. This engine can therefore be reversed in this way.

Figure 7:
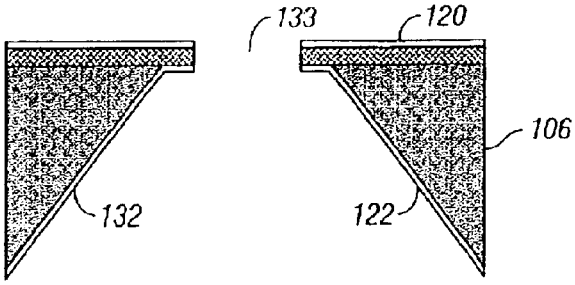
FIG. 7 shows an aperture to carry the gas into the ionization field.

When used in a vacuum, a low-pressure gas may need to be introduced into the membrane aperture that has a velocity sufficient to carry the gas into the ionization field. FIG. 7 shows an illustration of the way gas expands in a vacuum and has its molecules accelerated to supersonic speed while cooling, and directed through the membrane. Once ionized, the accelerating ions will create a partial vacuum behind them, which partial vacuum encourages further gas flow through the membrane. Gas that remains behind the membrane is ionized, and its negative field directs those ions through the membrane.

This system may have many different applications including biomedical applications such as a breath analyzer, as well as applications in other systems. It may have applications environment monitoring, personal monitoring, reviewing of water quality, automobile MAP control, detection of explosives, chemical and biological agent detection, and in an artificial nose type product.

What is claimed is:

1. A system for ionizing a sample of molecules, comprising:

an ionizing device, comprising a substrate having at least one opening, a first conductive electrode extending on a first surface of the substrate and a second conductive electrode extending on a second surface of the substrate, and a separator insulating element, having a thickness less than a mean free path of a molecule being ionized, separating said first and second conductive electrodes at said at least one opening, said first and second conductive electrodes being separated by a width of said separator insulating element; and a characterization unit coupled to said ionizing device, for receiving and characterizing ionized molecules from said ionizing device.

2. A system as in claim 1, wherein said first and second conductive electrodes are separated by less than 1 micron at said at least one opening.

3. A system as in claim 1, wherein said first and second conductive electrodes are separated by less than 300 nm at said at least one opening.

4. A system as in claim 1, wherein said first and second conductive electrodes are separated by less than 200 nm at said at least one opening.

5. A system as in claim 1 wherein said first and second conductive electrodes are separated by approximately 50 nm at said at least one opening.

6. A system as in claim 1 wherein said at least one opening tapers inwardly from the first surface of the substrate to the second surface of the substrate.

7. A system as in claim 1 wherein said at least one opening has a diameter approximately in the range of 2–3 microns.

8. A system as in claim 1, wherein said first and second electrodes are formed of one of gold, chrome or titanium.

9. A system as in claim 1, wherein said separator insulating element is a dielectric.

10. A system as in claim 9, wherein said separator insulating element is formed of silicon nitride or alumina.

11. A system as in claim 1, further comprising a lateral accelerator disposed between said ionizing device and said characterization unit for accelerating ions from said ionizing device to said characterization unit.

12. A system as in claim 11, wherein the accelerated ions are induced to traverse through said characterization unit without a pump.

13. A system as in claim 1, wherein said characterization unit is a Faraday cup electrometer ion detector.

14. A system as in claim 1, wherein said characterization unit is an ion mobility spectrometer.

15. A system as in claim 14, wherein said ion mobility spectrometer operates at substantially ambient pressure.

16. A system as in claim 15, further comprising a gas feed system to carry ionized gas molecules through said ion mobility spectrometer away from said ionizing device.

17. A system as in claim 16, wherein said gas feed system is an upstream gas carrier supply and a Venturi sampler.

18. A system as in claim 16, wherein said gas feed system is a downstream peristaltic pump.

19. A system as in claim 14, wherein said ion mobility spectrometer comprises a pair of filter electrodes which are configured to generate electric fields that control dispersal of ions received by said ion mobility spectrometer.

20. A system as in claim 19, wherein said pair of filter electrodes are configured to generate an electric field by applying a short high-voltage and a long lower voltage to said plurality of filter electrodes.

21. A system as in claim 19, wherein said filter electrodes generate an output having a zero tune averaged field.

22. A system as in claim 19, wherein said pair of filter electrodes are configured to generate an alternating electric field and a sweeping DC field for the transverse dispersal of ions received by said ion mobility spectrometer.

23. A system as in claim 19, wherein said pair of filter electrodes are configured to sequentially sweep the spectrum of ion species to detector electrodes.

24. A system as in claim 14, wherein said ion mobility spectrometer comprises a plurality of filter electrodes which are driven with electric fields that control ion dispersal.

25. A system as in claim 24, wherein said plurality of filter electrodes are configured to generate an alternating electric field and an opposing DC electric field for the transverse dispersal of ions received by said ion mobility spectrometer.

26. A system as in claim 24, wherein said plurality of filter electrodes are configured to generate an electric field by applying a short high-voltage and a long lower voltage to said plurality of filter electrodes.

27. A system as in claim 26, wherein said plurality of filter electrodes generates an output having a zero time averaged field.

28. A system as in claim 19, wherein said ion mobility spectrometer comprises at least two detector electrodes configured to detect impingement of ions at a specified location.

29. A system as in claim 28, wherein the molecules are continuously ionized and concurrently dispersed as ions to specific locations on said detector electrodes.

30. A system as in claim 28, wherein said detector electrodes are configured to directly measure ion current to determine the number of ions of a particular species contact said detector electrodes.

31. A system, as in claim 1, wherein said ionizing device ionizes all molecules passing therethrough without fracture such that a percentage of a particular species of ionized molecules is proportional to a vapor concentration of the particular species of ionized molecules.

32. A system as in claim 1, wherein electrons generated by said ionizing device move in a direction opposite to the generated ions and ionize further gas.

33. A system as in claim 1, wherein said characterization unit is a mass spectrometer.

34. A system as in claim 33, wherein said mass spectrometer system includes a solid-state electrode sensor array that detects ions.

35. A system as in claim 33, wherein said mass spectrometer system includes a time of flight system.

36. A system as in claim 33, wherein said mass spectrometer system comprises an array of pixellated electrodes.

37. A system as in claim 36, wherein said array of pixellated electrodes comprises an electrode sensor of 1024 by 1024 pixels.

38. A system as in claim 36, wherein said array of pixellated electrodes has a detection sensitivity of approximately $10^{-17}$ amps.

39. A system as in claim 33, wherein said mass spectrometer operates at a pressure of approximately 5 to 7 Torr.

40. A system as in claim 1, wherein said ionization device is configured to receive an exhaled breath from a patient and said characterization unit is configured to characterize the exhaled breath.

41. A system as in claim 40, wherein said characterization unit is configured to quantitate carbon monoxide within the exhaled breath.

42. A system as in claim 1, wherein said characterization unit is configured to analyze a sample passing therethrough for an application chosen from the group comprising: environmental monitoring, personal monitoring, water quality monitoring, automobile MAP control, detecting explosives, detecting chemical and biological agents, olfactory simulation.

43. A system for ionizing and detecting a sample of gas, comprising:

an ionizing device, comprising a substrate having at least one opening, a first conductive electrode extending on a first surface of the substrate and a second conductive electrode extending on a second surface of the substrate, said substrate having a thickness less than a mean free path of a gas molecule being ionized, separating said first and second conductive electrodes at said at least one opening, said first and second conductive electrodes being separated by a width of said substrate, wherein said ionizing device is configured to receive a continuous flow of sample gas; and a characterization unit coupled to said ionizing device, for receiving ionized molecules from said ionizing device.

44. A system for ionizing a sample of molecules, comprising:

an ionizing membrane having:

a thick supporting portion with a first surface and with openings formed in the thick supporting portion;

an insulating element with first and second surfaces, wherein the insulating element is coated on the first surface of the thick supporting portion and terminates at a first end within the openings to form holes;

a first electrodes coated on the first surface of the insulating element that approximately terminates at the first end of said insulating element;

a second electrode coated on the second surface of the insulating element that approximately terminates at the first end of said insulating element; and wherein a distance between the first and second metal electrodes within the holes is less than the mean free path of a material being ionized; and a characterization unit coupled to said ionizing membrane configured to receive ions from said ionizing membrane.

45. A method comprising the steps of:

forming a layer of thin dielectric material on a substrate that has a first specified thickness of a sufficient thickness to maintain structural integrity;

forming a first electrode on the first surface of said thin dielectric material, said first electrode being formed of a metal material;

back etching at least one hole in said substrate;

forming a second electrode an a second surface of the substrate including the at least one back etching holes, such that at least a portion of the second electrode is on a second surface of the thin dielectric material; and forming holes in the second electrode, thin dielectric material and the first electrode, which holes have side surfaces where the first and second electrodes are separated by a width of the thin dielectric material;

applying a voltage across said first and second electrodes to generate a field to ionize molecules passing through the at least one hole; and providing a characterization unit coupled to the at least one hole for receiving ions generated by the ionizing device.

46. A method as in claim 45, wherein said thin dielectric material has a thickness which is less than the mean free path of the gas intended to be ionized by the ionization membrane.

47. A method as in claim 45, wherein said forming electrodes comprises depositing gold, chrome, or titanium.

48. A method as in claim 45, wherein said forming a thin dielectric comprises depositing silicon nitride or alumina.

49. A method as in claim 45, wherein said thin dielectric has a thickness less than 500 nm.

50. A method as in claim 45, wherein said thin dielectric has a thickness less than 300 nm.

51. A method as in claim 50, further comprising the step of applying a voltage less than 15 volts between said first and second electrodes to form a field between said first and second electrodes in the range of megavolts per meter.

52. A method as in claim 45, wherein said thin dielectric has a thickness of approximately 50 nm.

53. A method as in claim 45, wherein said forming holes in the second electrode comprises ion-beam milling.

54. A method as in claim 45, wherein said forming a thin dielectric comprises silicon nitride or alumina.

55. A method as in claim 45, wherein said back etching at least one hole in said substrata forms at least one hole tapered inwardly.

56. A method as in claim 45, wherein the holes formed by said forming holes in the second electrode, thin dielectric material and the first electrode are approximately 2–3 microns in diameter.

57. A method comprising the steps of:

forming a layer of thin dielectric material on a substrate that has a first specified thickness of a sufficient thickness to maintain structural integrity;

forming a first electrode on the first surface of said thin dielectric material, said first electrode being formed of a metal material;

forming at least one hole in said substrate;

forming a second electrode on a second surface of the substrate including the at least one hole in said substrate, such that at least a portion of the second electrode is on a second surface of the thin dielectric material;

forming at least one hole in the second electrode, thin dielectric material and the first electrode, which at least one hole has side surfaces where the first and second electrodes are separated by a width of the thin dielectric material;

applying a voltage across said first and second electrodes to generate a field to ionize molecules passing through the at least one hole; and providing a characterization unit coupled to the at least one hole for receiving ions generated by the ionizing device.

58. A method as in claim 57 wherein said forming at least one hole in said substrate comprises ion-beam milling.

59. A method as in claim 57 wherein said forming at least one hole in the second electrode, thin dielectric material and the first electrode comprises ion-beam milling.

60. A method as in claim 57, wherein said thin dielectric material has a thickness which is less than the mean free path of the gas intended to be ionized by the ionizing source.

61. A method as in claim 57, wherein said forming electrodes comprises depositing gold, chrome or titanium.

62. A method as in claim 57, wherein said thin dielectric comprises silicon nitride or alumina.

63. A method as in claim 57, wherein said thin dielectric has a thickness less than 500 nm.

64. A method as in claim 57, wherein said thin dielectric has a thickness less than 300 nm.

65. A method as in claim 57, wherein said thin dielectric has a thickness loss than 200 nm.

66. A method as in claim 57, wherein said thin dielectric has a thickness of approximately 50 nm.

67. A method as in claim 57, further comprising applying a voltage less than 15 volts between said first and second electrodes to form a field between said first and second electrodes in the range of megavolts per meter.

68. A method as in claim 57, wherein said forming at least one hole in said substrate forms at least one hole tapered inwardly.

69. A system, comprising:

an ionizing device, comprising a support member having at least one opening, a first conductive electrode extending on a first surface of the support member and a second conductive electrode extending on a second surface of the support member, and separator means for separating said first and second conductive electrodes by a width of said separator means, wherein said separator means has a thickness less than the mean free path of the material being ionized; and characterization means coupled to said ionizing device for detecting ions generated by said ionizing device.

70. A system as in claim 69, wherein said separator means separates said first and second conductive electrodes by less than 1 micron at said at least one opening.

71. A system as in claim 69, wherein said separator means separates said first and second conductive electrodes by less than 300 nm at said at least one opening.

72. A system as in claim 69, wherein said separator means separates said first and second conductive electrodes by less than 200 nm at said at least one opening.

73. A system as in claim 69, wherein said separator means separates said first and second conductive electrodes by less than 50 nm at said at least one opening.

74. A system as in claim 69 wherein said at least one opening tapers inwardly from the first surface of the support member to the second surface of the support member.

75. A system as in claim 69 wherein said at least one opening has a diameter approximately in the range of 2–3 microns.

76. A system as in claim 69, wherein said separator means comprises a dielectric.

77. A system as in claim 69, wherein said separator means is formed of silicon nitride or alumina.

78. A system as in claim 69, wherein said first and second electrodes are formed of one of gold, chrome or titanium.

79. A system as in claim 69, wherein said characterization means comprises an element which receives ions from said ionizing device.

80. A system as in claim 69, wherein said characterization means is a Faraday cup electrometer ion detector.

81. A system as in claim 69, wherein said characterization means is an ion mobility spectrometer.

82. A system as in claim 81, wherein said ion mobility spectrometer operates at substantially ambient pressure.

83. A system as in claim 81, further comprising a gas feed system to carry ionized gas molecules through said ion mobility spectrometer away from said ionizing device.

84. A system as in claim 83, wherein said gas feed system is an upstream gas carrier supply and a Venturi sampler.

85. A system as in claim 83, wherein said gas feed system is a downstream peristaltic pump.

86. A system as in claim 81, wherein said ion mobility spectrometer comprises at least two filter electrodes which are driven with electric fields that control ion dispersal.

87. A system as in claim 86, wherein said at least two filter electrodes are configured to generate an electric field by applying a short high-voltage and a long lower voltage to said plurality of filter electrodes.

88. A system as in claim 87, wherein said at least two filter electrodes produces an output having a zero time averaged field.

89. A system as in claim 86, wherein said at least two filter electrodes are configured to generate alternating electric fields and an opposing DC electric field for the transverse dispersal of ions received by said ion mobility spectrometer.

90. A system as in claim 81, wherein said ion mobility spectrometer comprises at least two detector electrodes configured to detect impingement of ions at a specified location.

91. A system as in claim 69, wherein electrons generated by said ionizing device move in a direction opposite to the generated ions and act to further ionize molecules.

92. A system as in claim 69, wherein said characterization means is a mass spectrometer.

93. A system as in claim 92, wherein said mass spectrometer system includes a solid-state electrode sensor array that detects ions.

94. A system as in claim 92, wherein said mass spectrometer system includes a time of flight system.

95. A system for ionizing and characterizing a sample of gas, comprising:

an ionizing device, comprising a substrate having at least one opening, a first conductive electrode extending on a first surface of the substrate and a second conductive electrode extending on a second surface of the substrate, said substrate having a thickness less than a mean free path of a gas molecule being ionized, separating said first and second conductive electrodes at said at least one opening, said first and second conductive electrodes being separated by a width of said substrate;

a characterization unit coupled to said ionizing device, for receiving ionized molecules from said ionizing device; and wherein said characterization unit and said ionizing device may operate at substantially ambient pressure.

96. A mass spectrometer system comprising an ionization source and a plurality of detector electrodes, wherein said ionizing source comprises two electrodes having a spacing less than a mean free path of a molecule being ionized which generate electric fields that ionizes substantially all molecules without fragmentation and said detector electrodes characterize the ionized molecules.

97. A system for ionizing a sample of gas comprising:

an ionizing device, comprising a substrate having at least one opening, a first conductive electrode extending on a first surface of the substrate and a second conductive electrode extending on a second surface of the substrate, said first and second conductive electrodes being separated at said at least one opening by a width less than a mean free path of a gas molecule being ionized;

a characterization unit coupled to said ionizing device, for receiving and characterizing ionized molecules from said ionizing device; and wherein said characterization unit and said ionizing device are configured to transversally disperse ions at substantially ambient pressure.

98. A method for ionizing and dispersing a sample of molecules comprising the steps of:

providing an ionizing device having one or more pairs of electrodes having a spacing less than the mean free path of the molecule being ionized;

applying a voltage across the pair of electrodes to generate a field to ionize substantially all molecules passing between the pair of electrodes;

ionizing molecules passing through the electric field generated by the pair of electrodes; and accelerating the ionized molecules using a later accelerator and substantially without a pump.

99. A method of claim 98 further comprising the step of characterizing the accelerated ionized molecules.

* * * * *